US006347862B1

(12) United States Patent
Kanno et al.

(10) Patent No.: US 6,347,862 B1
(45) Date of Patent: Feb. 19, 2002

(54) INK-JET HEAD

(75) Inventors: Isaku Kanno, Yamatokoriyama; Satoru Fujii, Takatsuki; Ryoichi Takayama, Suita; Takeshi Kamada, Nara, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/202,419

(22) PCT Filed: Apr. 14, 1998

(86) PCT No.: PCT/JP98/01691

§ 371 Date: Dec. 14, 1998

§ 102(e) Date: Dec. 14, 1998

(87) PCT Pub. No.: WO98/46429

PCT Pub. Date: Oct. 22, 1998

(30) Foreign Application Priority Data

Apr. 14, 1997 (JP) ..... 9-095491

(51) Int. Cl.[7] ..... B41J 2/045

(52) U.S. Cl. ..... 347/68; 347/70; 347/47; 347/44

(58) Field of Search ..... 347/68, 72, 70, 347/47, 44

(56) References Cited

U.S. PATENT DOCUMENTS 5,648,012 A * 7/1997 Higashibeppu et al. ..... 501/134
5,719,607 A * 2/1998 Hesegawa et al. ..... 347/70
5,874,975 A * 2/1999 Hotomi et al. ..... 347/68
6,091,183 A * 7/2000 Nishimura et al. ..... 310/358

FOREIGN PATENT DOCUMENTS

| | | |
|---|---|---|
| EP | 0 656 429 | 6/1995 |
| EP | 0714866 | 6/1996 |
| JP | 5-286132 | 11/1993 |
| JP | 8-118630 | 5/1996 |
| JP | 8-259323 | 10/1996 |

* cited by examiner

*Primary Examiner*—John Barlow
*Assistant Examiner*—Manish S. Shah
(74) *Attorney, Agent, or Firm*—Wenderoth, Lind & Ponack, L.L.P.

(57) ABSTRACT

There is provided an ink-jet head having ink outlets formed at a high density for use in an ink-jet recorder. The ink-jet head comprises ink outlets, compression chambers communicating with the ink outlets, and piezoelectric vibration sections, each being provided on a part of each of the compression chambers and including a piezoelectric film containing Pb, Ti and Zr, and electrodes provided on both sides of the piezoelectric film. The piezoelectric film comprises a first layer and a second layer which each have a perovskite structure and are formed in contact with each other, wherein the first layer is formed as a layer containing no Zr or as a layer containing a smaller amount of Zr than that contained in the second layer.

20 Claims, 13 Drawing Sheets

INK-JET HEAD

FIELD OF THE INVENTION

The present invention relates to ink-jet heads for use in ink-jet recorders.

BACKGROUND OF THE INVENTION

Recently, printers incorporating ink-jet recorders come into wide use as printers for personal computers and the like because of their high printing performance, handling ease, inexpensiveness and the like. There are a variety of ink-jet recorders of this type: some of them jet ink droplets utilizing pressure waves which are caused by bubbles formed in ink by thermal energy; some of them suck and jet ink droplets utilizing static electric power; some of them jet ink droplets utilizing pressure waves which are caused by vibrators such as piezoelectric elements, and the like.

Generally, the ink-jet recorders using piezoelectric elements comprise, for example, compression chambers communicating with ink-supply chambers and ink outlets communicating with the compression chambers, wherein the compression chambers are provided with vibration plates bonded with piezoelectric elements. In such a structure, when a given voltage is applied to the piezoelectric elements to expand or contract them, the piezoelectric elements vibrate bending themselves to compress the ink in the compression chambers, thereby jetting ink droplets from the outlets. Today, while color ink-jet recorders are coming into wide use, improvement on the printing performance, particularly high resolution and high-speed printing are demanded. Therefore, there are seen many trials to realize high resolution and high-speed printing by using multi-nozzle heads which are achieved by fine processing of ink heads. To finely process ink heads, it becomes necessary to miniaturize piezoelectric elements for use in jetting ink droplets.

In the meantime, the piezoelectric films of piezoelectric elements are formed by molding powder of PbO, $ZrO_2$ and $TiO_2$ into sheets and baking the molded sheets, and therefore, it is difficult to form piezoelectric thin films with a thickness of, for example, 20 $\mu$m or less. For this reason, fine processing of piezoelectric films is accompanied by difficulties, which leads to difficulties in miniaturizing the piezoelectric elements. Further, in the above piezoelectric films formed by baking the powder, as their thickness is becoming smaller, the affection of the thickness on the grain boundary is becoming serious, so that sufficient piezoelectric characteristics can not be obtained. As a result, there is a problem in that the piezoelectric films formed by baking the powder can not provide sufficient piezoelectric characteristics to jet ink droplets when the thickness of the films is 15 $\mu$m or less. Therefore, miniaturized ink heads having characteristics necessary for jetting ink droplets have not been realized.

DISCLOSURE OF THE INVENTION

Objects of the present invention are to provide structures for ink-jet heads having ink outlets which are formed at a high density, by developing thin film materials which have high piezoelectric characteristics in spite of very small thickness and forming piezoelectric films, vibration plates and the like therefrom with very small thickness for constituting piezoelectric elements, thereby making it possible to utilize fine processing techniques which have been applied to the field of the semiconductor processing, and also to provide methods for producing ink-jet heads having such structures.

A first ink-jet head according to the present invention comprises a body having ink outlets and compression chambers respectively communicating with each of the ink outlets, and piezoelectric vibration sections, each being provided on a part of each of the compression chambers and including a piezoelectric film containing Pb, Ti and Zr, and electrodes provided on both sides of the piezoelectric film, whereby each of the piezoelectric vibration sections generates flexural vibration to thereby jet ink droplets from each of the ink outlets, characterized in that the above piezoelectric film comprises a first layer having a perovskite structure containing Sr or Ba, and a second layer formed in contact with the first layer, having a perovskite structure containing Pb, Ti and Zr.

As mentioned above, by forming the second layer in contact with the first layer having a perovskite structure containing Sr or Ba, the second layer containing Zr can be formed thinner, having a higher quality and a larger piezoelectric constant. With this configuration, the first ink-jet head of the present invention can be made very small in size and light in weight.

A second ink-jet head according to the present invention comprises a body having ink outlets and compression chambers respectively communicating with each of the ink outlets, and piezoelectric vibration sections, each being provided on a part of each of the compression chambers and including a piezoelectric film containing Pb, Ti and Zr, and electrodes provided on both sides of the piezoelectric film, whereby each of the piezoelectric vibration sections generates flexural vibration to thereby jet ink droplets from each of the ink outlets, characterized in that the above piezoelectric film comprises a first layer and a second layer, each having a perovskite structure and being formed in contact with each other, and that the content of Zr in the first layer is smaller than that in the second layer.

As mentioned above, by composing the piezoelectric film of the first layer and the second layer which are formed in contact with each other, the second layer containing comparatively more amount of Zr can be formed thinner, having a good quality and a larger piezoelectric constant. With configuration, the second ink-jet head of the present invention can be made very small in size and light in weight.

A third ink-jet head according to the present invention comprises a body having ink outlets and compression chambers respectively communicating with each of the ink outlets, and piezoelectric vibration sections, each being provided on a part of each of the compression chambers and including a piezoelectric film containing Pb, Ti and Zr, and electrodes provided on both sides of the piezoelectric film, whereby each of the piezoelectric vibration sections generates flexural vibration to thereby jet ink droplets from each of the ink outlets, characterized in that the above piezoelectric film comprises a first layer containing no Zr and a second layer containing Zr, each having a perovskite structure and being formed in contact with each other. Thus, the second layer can have a better quality and a higher piezoelectric constant in comparison with the above second ink-jet head.

In the second and third ink-jet heads of the present invention, to form the first layers simply and at low temperatures, it is preferable for the first layers to contain La.

Also, in the first to the third ink-jet heads of the present invention, it is preferable for the second layers to have a Zr/Ti ratio within a range of 30/70 to 70/30 so as to further increase the piezoelectric constants of the above piezoelectric films.

Also, in the first to the third ink-jet heads of the present invention, it is more preferable for the above piezoelectric films to be single crystal so that the piezoelectric constants which the materials constituting the piezoelectric films inherently possess can be effectively utilized.

Also, in the first to the third ink-jet heads of the present invention, it is preferable for the above piezoelectric films to be formed with a thickness of 10 μm or less so that the piezoelectric films can be finely processed.

Also, in the first to the third ink-jet heads of the present invention, it is more preferable for the above piezoelectric films to be formed with a thickness within a range of 1 to 3 μm so that the piezoelectric films can be finely processed, and simultaneously that the ink heads can have sufficient ink-jetting powers and sufficiently reliable piezoelectric films. In this case, it is preferable for the first layers to be formed with a thickness within a range of 50 to 100 nm so that the second layers can be formed having better qualities. Thus, the piezoelectric constants of the piezoelectric films as a whole do not decrease.

Also, in the first to the third ink-jet heads of the present invention, by providing the above piezoelectric vibration sections with vibration plates, the piezoelectric vibration sections can easily generate flexural vibration. In this case, it is preferable that the above vibration plates are formed from at least one selected from the group consisting of Ni, Cr, Al and their oxides, Si, Si oxide, and high molecular compound.

Also, in the first to the third ink-jet heads of the present invention, each of the above piezoelectric vibration sections may generate flexural vibration by two piezoelectric films: that is, another piezoelectric film different from the above piezoelectric film is provided between each of the above electrodes, opposing to each other through an intermediate electrode layer. By the piezoelectric vibration section using two piezoelectric films as mentioned above, a larger vibration amplitude can be obtained as compared with the ink heads using vibration plates.

Also, in the first to the third ink-jet heads of the present invention, each of the second layers of the above piezoelectric films may be a piezoelectric matter which contains Nb and Sn and has antiferroelectricity.

Also, in the first to the third ink-jet heads of the present invention, the first layer of each of the above piezoelectric films may be formed as a layer in which the density of Zr is so distributed as to continuously increase along the thickness direction of the first layer, and which contacts the second layer at one side thereof having a higher Zr density.

Also, in the first to the third ink-jet heads of the present invention, it is preferable that the above electrode layers on both sides of each piezoelectric film are formed from Pt or Au. By doing so, the electrodes are not damaged by etchant, for example, when the piezoelectric film is finely processed by etching.

Also, in the first to the third ink-jet heads of the present invention, each of the bodies has a plurality of ink outlets and a plurality of compression chambers which are provided respectively corresponding to each of the ink outlets, respectively, and at least one of the electrodes provided on both sides of the piezoelectric film is divided into such patterns that can be separately disposed corresponding to the compression chambers, respectively, so that there can be provided an ink-jet head which comprises piezoelectric vibration sections, each corresponding to each of the compression chambers. With the structure as mentioned above, an ink-jet head which has a plurality of ink outlets formed at a very high density can be provided. In this case, the piezoelectric film may be divided into separate piezoelectric films which correspond to the compression chambers, respectively, and one of the above electrodes may be formed over the piezoelectric films divided. This can also provide an ink-jet head which has ink outlets formed at a high density. As described above, where the divided piezoelectric films are separately formed so as to correspond to the compression chambers, respectively, it is preferable that the width of each of the piezoelectric films is smaller than that of each of the compression chambers. Also, where the divided piezoelectric films are separately formed, a resin having such a low rigidity as not to prevent expansion or contraction of the piezoelectric film may be packed in the spaces between each of the piezoelectric films separated. By doing so, the reliability of the ink-jet head can be improved.

Also, in the first to the third ink-jet heads of the present invention, each of the piezoelectric vibration sections may be bonded at its periphery to the periphery of each compression chamber through a resin layer having elasticity and a thickness of 3 μm or less. By doing so, deformation of the piezoelectric vibration section is prevented when it is bonded to the compression chamber, so that the production yield is increased and the reliability of the ink-jet head is improved.

It is preferable that the piezoelectric vibration section is bonded at its periphery to the periphery of the compression chamber through a mount which is formed from a ceramics, metal or resin. By doing so, the bonded portion can be distant from the piezoelectric vibration section, so that the above piezoelectric vibration section can be stably vibrated.

In the meantime, the method, according to the present invention, of producing an ink-jet head which comprises a body having ink outlets and compression chambers, each communicating with each of the ink outlets and having an opening at a part thereof; and piezoelectric vibration sections so provided as to close the openings of the compression chambers is as follows. The method comprises a first step of forming piezoelectric vibration sections, each including a substrate and a piezoelectric film thereon, said step including a step of forming the piezoelectric film comprised of a first layer and a second layer, by forming, on the substrate, the first layer which has a perovskite structure containing Pb and Ti, and forming, on the first layer, the second layer which has a perovskite structure containing Zr, Pb and Ti, a second step of facing the peripheries of the openings of the body to the peripheries of the piezoelectric vibration sections and bonding them to each other, and a third step of removing the substrate after the bonding, and the method is characterized in that the first layer is so formed as not to contain Zr, or as to contain a smaller amount of Zr than that contained in the second layer in the first step.

By the method of the present invention, the second layer which contains a comparatively larger amount of Zr can be formed with a small thickness, having a good quality and a large piezoelectric constant. Thus, according to the method of the present invention, there can be provided an ink-jet head which is made very small in size and light in weight.

In the method of the present invention, preferably, the sputtering process or the chemical vapor deposition (CVD) process is adopted so as to accurately form the first layer and the second layer having good qualities.

In the method of the present invention, by using an MgO substrate as the above substrate, the first layer and the second layer can be formed as single crystal layers. In this case, the substrate can be removed by etching using phosphoric acid in the third step.

In the method of the present invention, a silicone substrate or a glass substrate can be used as the above substrate. For the use of such a substrate, an ink-jet head can be produced at lower cost as compared with that produced by using an MgO substrate. In this case, the substrate can be removed by etching using a hydrofluoric acid solution or a potassium hydroxide solution in the third step.

BEST MODES FOR CARRYING OUT THE PRESENT INVENTION

Hereinafter, the embodiments of the present invention will be described with reference to the accompanying drawings.

The First Embodiment

An ink-jet head (100) according to the first embodiment of the present invention comprises a thin piezoelectric film having a large piezoelectric constant, which is formed by what is called a thin-film forming process such as a sputtering process which has hitherto been hardly applied to this field. The ink-jet head (100) of the present invention has features in that it can be made very small in size, having ink outlets which are spaced at narrow intervals to each other, as compared with conventional ink-jet heads.

Figure 1A:
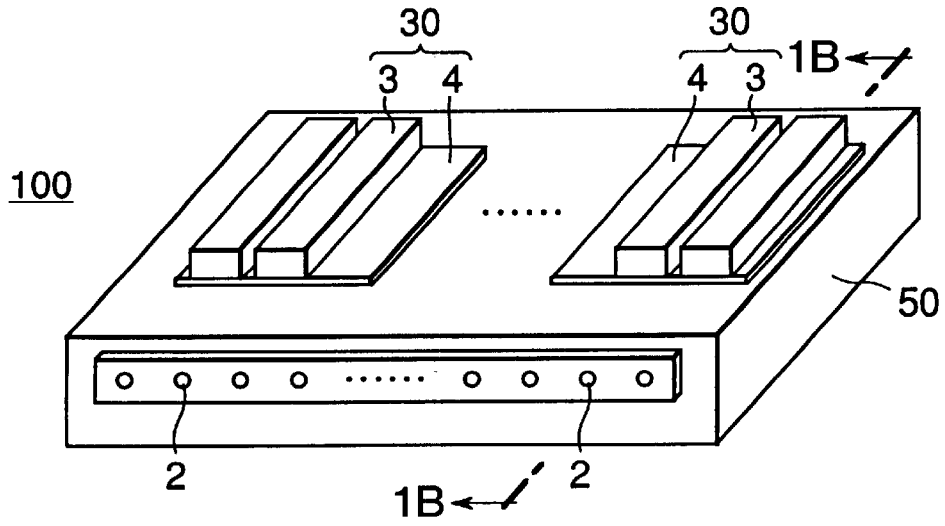
FIG. 1A is a perspective view of an ink-jet head of the first embodiment according to the present invention, illustrating the structure of the ink-jet head.
Figure 1B:
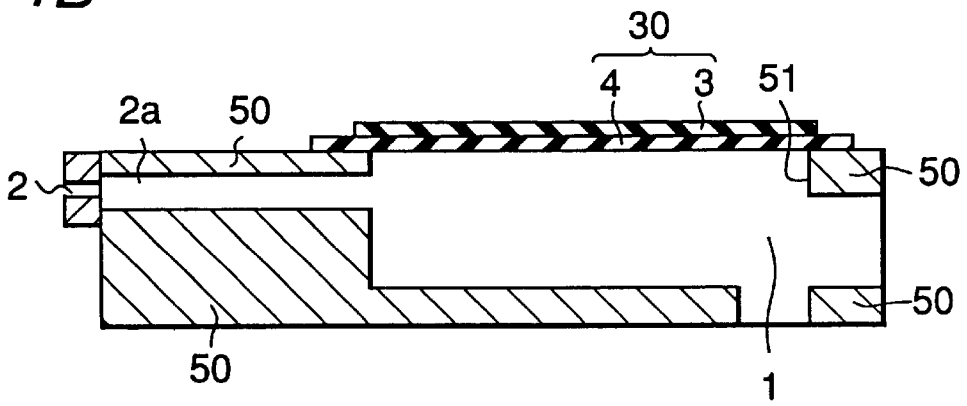
FIG. 1B is a sectional view of the ink-jet head taken along line 1B—1B of FIG. 1A.

FIG. 1A is a perspective view of the ink-jet head (100) according to the first embodiment of the present invention, and FIG. 1B is a sectional view of the ink-jet head (100) taken along line 1B—1B.

The ink-jet head (100), as shown in FIGS. 1A and 1B, comprises a plurality of outlets (2); a plurality of compression chambers (1), each being provided corresponding to each outlet (2); and a plurality of piezoelectric elements (3), each being provided for each compression chamber (1).

In the ink-jet head (100), the outlets (2) are formed at regular intervals in a side plane of the body (50), and the compression chambers (1) are formed corresponding to the outlets (2), respectively, and in parallel with the body (50). Each of the outlets (2) communicates with each of the compression chamber (1) through each ink passage **(2*a*) formed in the body (50). Also, openings (51) are each formed corresponding to each of the compression chambers (1) in the top of the body (50), and also, vibration plates, (4) are formed on the top of the body (50) so as to close the openings (51). Further, piezoelectric elements (3) are each provided on the vibration plate (4) so as to be positioned on each of the openings (51), corresponding to each of the compression chambers (1)**.

Figure 2:
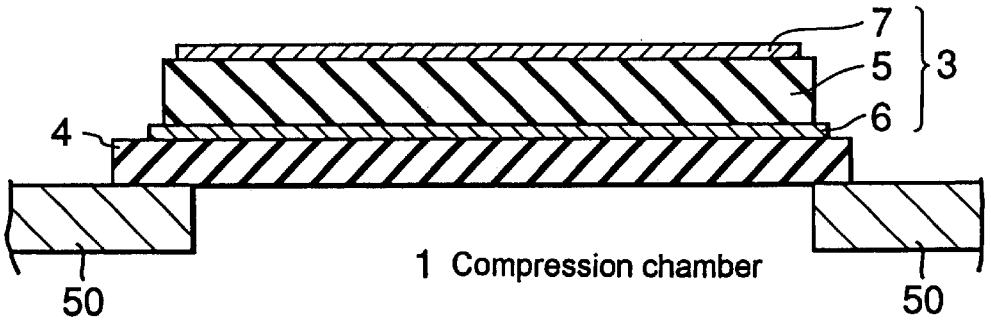
FIG. 2 is an enlarged partial sectional view of a piezoelectric vibration section of the ink-jet head of the first embodiment.

Each of the piezoelectric elements (3), as shown in FIG. 2, comprises electrodes (6) and (7) each formed from platinum with a thickness of 0.1 $\mu$m; and a piezoelectric film (5) formed with a thickness of 3 $\mu$m between the electrodes (6) and (7), and they are disposed on the vibration plate (4). The vibration plate (4) is comprised f a $SiO_2$ layer with a thickness of 2 $\mu$m in the vibrating art. As mentioned above, a piezoelectric vibration section (30) is comprised of the piezoelectric element (3) and the vibration plate (4). The use of a perovskite type PZT thin film material which is an oxide of lead, titanium and zirconium, as a material for the piezoelectric film (5) can provide sufficient vibrations even at a low voltage. The abbreviation "PZT" referred to in the description of the specification means a piezoelectric material which contains Pb, Zr and Ti and is represented by the general formula of $Pb(Zr_xTi_{1-x})O_3$. It is confirmed that, when the composition formula of a PZT thin film is $Pb(Zr_{0.53}Ti_{0.47})O_3$, the film exhibits maximal piezoelectricity in the form of a sintered body. However, it is difficult to form a thin film of this composition formula directly on the electrode.

Figure 3:
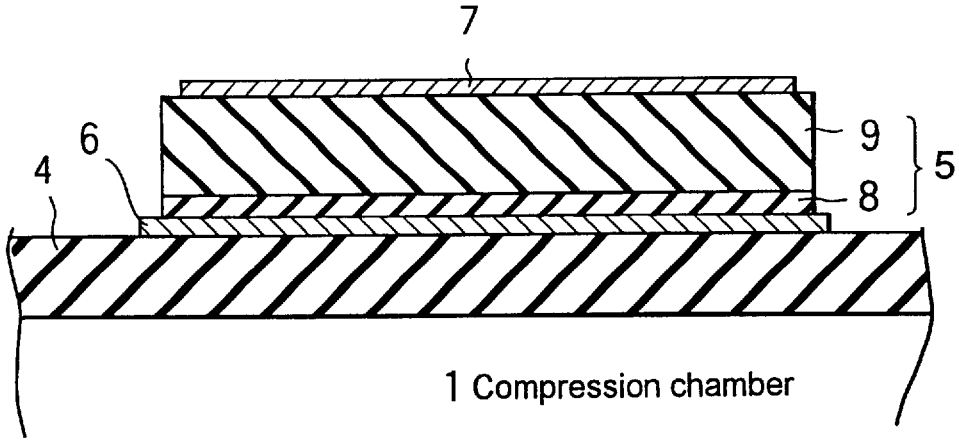
FIG. 3 is an enlarged partial sectional view of a piezoelectric film (5) of the ink-jet head of the first embodiment.

To solve the above problem, in the first embodiment, the piezoelectric film (5) is comprised,of two layers as shown in FIG. 3. As the first layer (8), a layer of the composition formula of $PbTiO_3$, or PLT, i.e. $PbTiO_3$ and additional lanthanum (La) is formed, and as the second layer (9), a layer of the composition formula of $Pb(Zr_{0.53}Ti_{0.47})O_3$ is formed. The piezoelectric film (5) thus formed is found to be a high quality piezoelectric film having sufficient piezoelectric characteristics. That is, the present invention has been achieved based on such a finding that a high-quality piezoelectric film having sufficient piezoelectric characteristics can be provided by forming a first layer of $PbTiO_3$ containing no Zr or of PLT, i.e. $PbTiO_3$ to which lanthanum (La) is added, and forming a second layer of $Pb(Zr_{0.53}Ti_{0.47})O_3$.

Hereinafter, the piezoelectric film (5) comprised of two layers will be described in more detail.

As described above, it is known that PZT shows excellent piezoelectric characteristics and can have a very high piezoelectric coefficient when the ratio of Zr/Ti is about 50/50. However, it is difficult that an excellent layer is formed from PZT by the thin film forming process such as the sputtering process, CVD process or the like, and the higher the ratio of Zr to Ti, the more difficult the formation of a sufficient layer. We have studied and examined this problem and found out that an oxide of Zr adsorbs the surface of a substrate in process of forming a thin film and, thereafter, hinders the growth of a film. It is also found that this tendency becomes more significant when a PZT film is allowed to grow on a Pt electrode. However, this problem can be solved as follows: an excellent PZT film can be formed without deposition of Zr oxide when PZT is allowed to grow by the thin film forming process on a layer of $PbTiO_3$ or a layer of (Pb, La)$TiO_3$ (hereinafter referred to as simply "PLT"), that is, a mixture of $PbTiO_3$ and about 10 mol. % of La which lowers the crystallization temperature. $PbTiO_3$ and PLT have a perovskite structure as well as PZT, and they can be easily formed into films even on Pt electrodes by the thin film forming process. It is necessary for the first layer to have a perovskite structure as an essential requirement. We have already demonstrated from our studies that similar effect can be obtained from $SrTiO_3$, $BaTiO_3$, $SrRuO_3$ and the like other than $PbTiO_3$ and PLT. Also, the first layer can be formed using an RF sputtering apparatus as well as a PZT layer. By using the sputtering apparatus on which multi-element targets can be mounted, the first layer (8) and the second layer (9) can be formed in sequential steps.

In the present invention, the same effect can be provided when the piezoelectric film (5) is comprised of, not such a multi-layer structure but of a first layer having a gradient composition formula in which the composition continuously varies from $PbTiO_3$ containing no Zn to approximate $Pb(Zr_{0.5}Ti_{0.5})O_3$.

Hereinafter, a method of producing an ink-jet head according to the first embodiment will be described with reference to the flowchart shown in FIG. 5A.

Figure 5A:
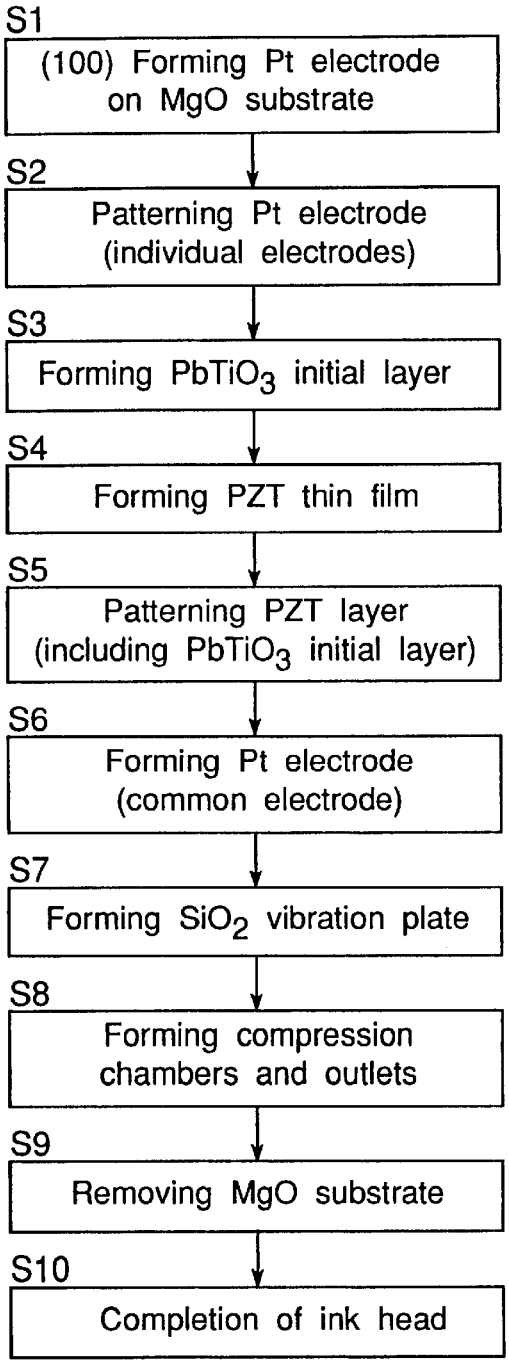
FIG. 5A is a flowchart for describing the main steps of one example of the methods of producing an ink-jet head of the first embodiment.

In the method of producing the first embodiment, first, single crystal of Pt are allowed to orient to form an electrode film with a thickness of 0.1 $\mu$m on an upper face (100) of a single crystal MgO substrate (10) of 2 cm square (Step S1 in FIG. 5A).

Figure 4:
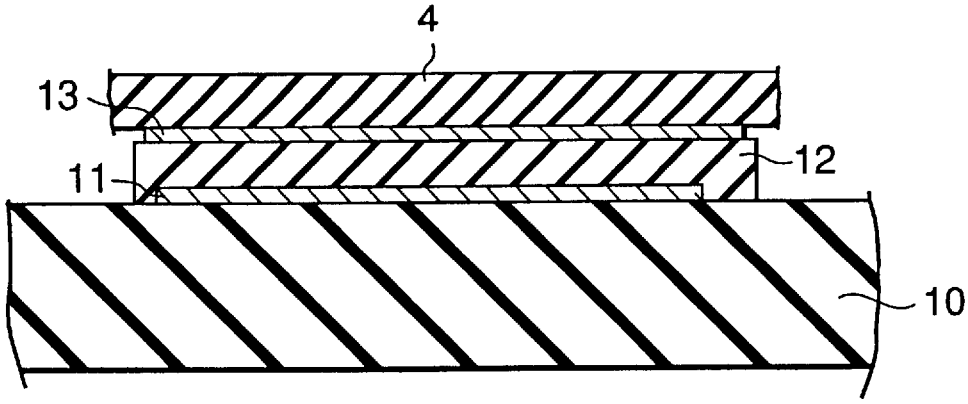
FIG. 4 is a sectional view of a piezoelectric vibration section formed on an MgO substrate (10), illustrating a method of producing the ink-jet head of the first embodiment.

Next, the Pt electrode film is subjected to patterning into separate and individual electrodes (11) by dry etching (utilizing actions of Ar ions under vacuum) so as to correspond to the respective compression chambers (Step S2 in FIG. 5A in connection with FIG. 4).

Next, an initial layer (a first layer) of $PbtiO_3$ is formed with a thickness of about 0.01 $\mu$m (Step S3 in FIG. 5A).

Then, a PZT thin film is formed with a thickness of about 3 $\mu$m on the initial layer by the sputtering process (Step S4 in FIG. 5A).

In this regard, the temperature of the substrate is controlled at 500 to 600° C. so as to grow the film in Steps S3 and S4.

As described above, in the method for the first embodiment, the initial layer of $PbTiO_3$ is formed before the formation of the PZT thin film, so that there can be formed the single crystal PZT thin film which has the crystals orienting toward the axis c, having little non-uniformity in the composition and having high crystallinity. In addition, the PZT film shows the highest piezoelectric coefficient in the axial direction c.

Next, the PZT thin film (including the initial layer) is subjected to patterning by etching using a strong acidic solution, so that the PZT thin film is formed into separate and individual piezoelectric films (12) which correspond to the respective compression chambers (Step S5 in FIG. 5A in connection with FIG. 4)

Next, a common electrode (13) is formed on the piezoelectric films (12) (Step S6 in FIG. 5A in connection with FIG. 4). The common electrode may be formed as individual electrodes corresponding to the individual piezoelectric films (12), respectively, as shown in FIG. 4, or it may be formed as a continuous electrode over a plurality of individual piezoelectric films (12).

Next, a vibration plate (4) is formed from $SiO_2$ with a thickness of 2 $\mu$m on the common electrode (13) (Step S7 in FIG. 5A). Although not shown in FIG. 4, a resin is packed at both sides of the individual piezoelectric films (12) to level a surface for forming the vibration plate (4) before the formation of the vibration plate (4).

After completion of the formation of the above respective layers on the MgO substrate, the vibration plate (4) is bonded with adhesive to a body which is made of stainless steel and has compression chambers and ink passages previously formed therein. Thus, the compression chambers and ink passages are formed on the vibration plate (Step S8 in FIG. 5A). It is preferable for the adhesive to have a comparatively high hardness so as not to absorb piezoelectrical vibrations.

Next, finally, the MgO substrate (10) is removed using an acidic solution (Step S9 in FIG. 5A). The MgO substrate (10) can be safely dissolved without any damage on the piezoelectric films by using a phosphoric acid solution as the acidic solution.

Further, a plane having outlets with a diameter of, for example, 10 $\mu$m formed at given intervals is assembled to the side plane of the body. Thus, the ink-jet head of the first embodiment is completed.

Figure 5B:
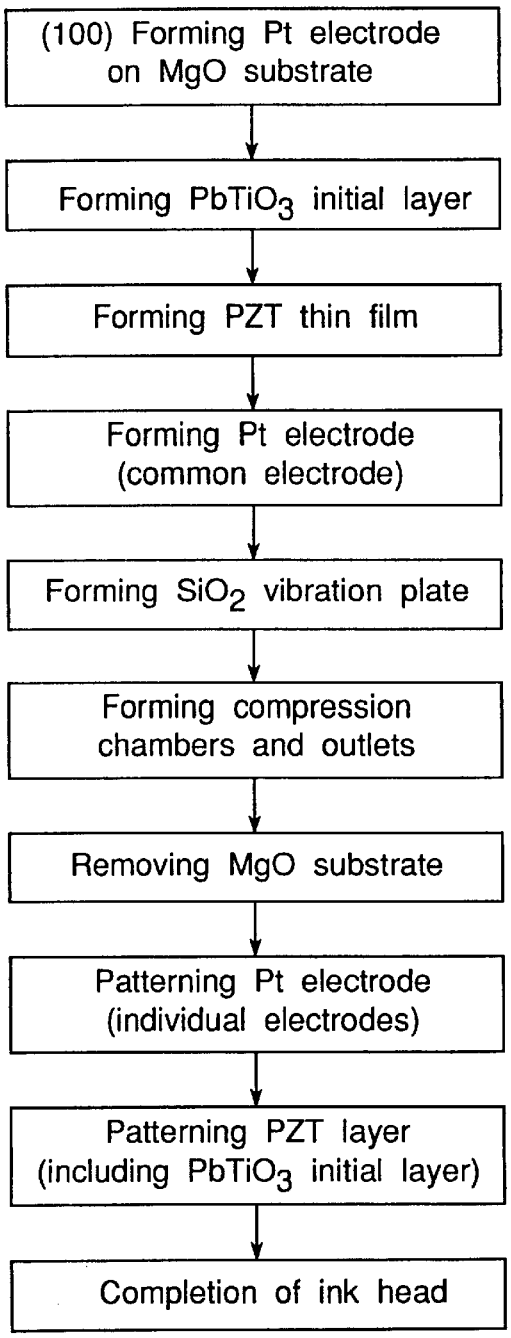
FIG. 5B is a flowchart illustrating a different example of the methods.

In the method as described with reference to the flowchart of FIG. 5A, the piezoelectric film and the individual electrodes (11) are patterned before the formation of the common electrode (13). However, the present invention is not limited to this method, and the piezoelectric film and the Pt individual electrodes may be subjected to patterning after the formation of the common electrode (13) and the etching of the MgO substrate (10) as described in the flowchart in FIG. 5B.

According to the production method as described above, a thin piezoelectric film having excellent piezoelectric characteristics can be formed. Further, by applying fine processing techniques for use in production of semiconductors to the resultant thin piezoelectric film, a piezoelectric element which can correspond to a very small compression chamber can be formed, so that an ink-jet head having outlets formed at a high density can be provided.

Figure 6:
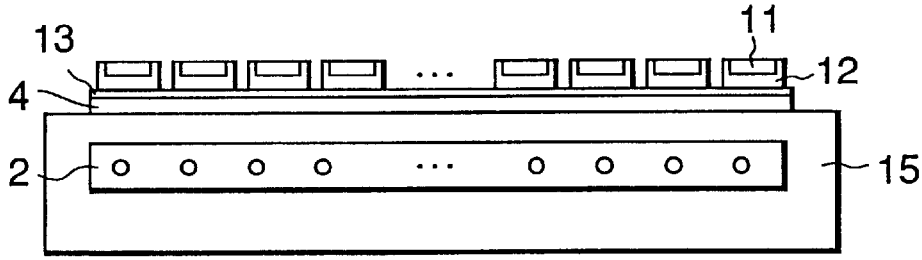
FIG. 6 is a front view of the ink-jet head of the first embodiment.

For example, in producing a nozzle head with a density of 150 dpi, the widths of compression chambers are usually set to 100 μm and those of partition walls between each of the adjacent compression chambers to about 66 μm. However, when the thickness of a PZT thin film is decreased to 5 μm or less, it becomes possible enough to process the PZT thin film into film strips with a width of 50 μm or less, so that it makes sure to process the piezoelectric film into shaped films having such a size that can correspond to a compression chamber with a width of 100 μm. In this regard, there are difficulties in processing a conventional piezoelectric film with a thickness of 20 μm or more into piezoelectric film strips with a width of 50 μm. On the other hand, in the first embodiment, it is possible to process the piezoelectric film into film strips with a width of 20 μm or less. Accordingly, it is also possible to provide a nozzle head having a density of 500 dpi or more depending on possible shapes and sizes of the processed piezoelectric films. FIG. 6 is a front view of a nozzle head having outlets (or nozzles) formed at a density of 200 dpi, provided by the above method.

Further, by decreasing the width of compression chambers, the resonance frequency of the compression chamber can be increased, which leads to an advantage that the nozzle head can be driven at a proportionally increased frequency. Further, the drive of the nozzle head at a higher frequency leads to a quicker response to an applied voltage, so that it becomes possible to subtly control the ink-jetting amount. Therefore, the color gradation of a printed image can be improved. In this regard, when the width of the compression chamber is 100 μm (corresponding to 150 dpi), the resonance frequency is about 1 MHz.

The ink-jetting performance is generally expressed by a product of bending amount Y and generated pressure P. This value is expressed by the following equation (1), provided that the thickness of a piezoelectric film is t, the piezoelectric constant is $d_{31}$, and the voltage is V. Accordingly, this provides an advantage that the use of a thin film makes it possible to decrease the voltage applied.

$$Y \cdot P = k \cdot d_{31}^2 \cdot V^2 / t \qquad \text{Equation (1)}$$

Figure 7:
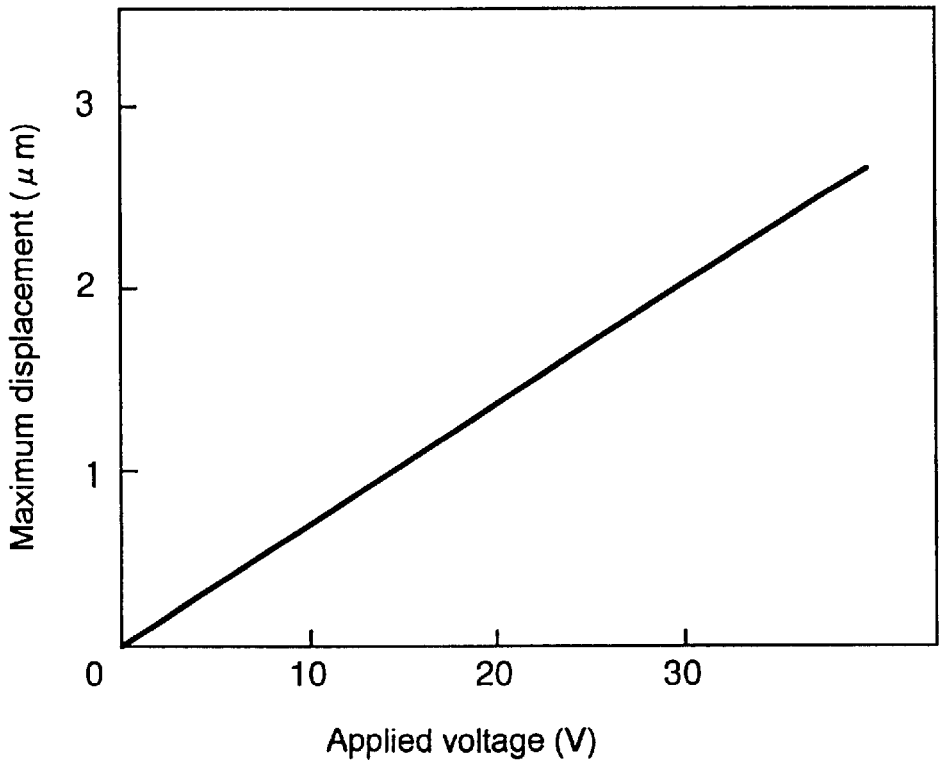
FIG. 7 is a graph showing a bending amount of the vibration plate relative to an applied voltage in one example of the ink-jet heads of the first embodiment.

In accordance with the above method, a PZT thin film in which the ratio of Zr/Ti is 50/50 is subjected to patterning so as to obtain samples each having a width of 10 μm and a length of 1 mm which correspond to each of the compression chambers (1). Using these samples, a relationship between an applied voltage and a maximal bending amount of a vibration plate (4) was measured. FIG. 7 shows the results. It is known from the graph shown in FIG. 7 that the application of an increased voltage bends the vibration plate and that the vibration plate is displaced by about 2 μm relative to the application of 30 V. Thus, it is confirmed that an ink-jet head having high ink-jetting performance can be provided by utilizing the above excellent piezoelectric characteristics.

As described above, the ink-jet head of the first embodiment is formed by processing the thin piezoelectric film (5) which has excellent piezoelectric characteristics and which is composed of the perovskite type first layer containing no Zr and the second layer formed from PZT containing Zr. By doing so, finely processed piezoelectric films (5) having excellent piezoelectric characteristics can be formed. Therefore, there can be provided an ink-jet head which is made very small in size and has ink outlets formed therein at a high density, as compared with the conventional ink-jet heads.

The foregoing description has been made giving specific materials and numerical values, however, the present invention is not limited by the above numerical values.

As for the first layer (the initial layer) of the piezoelectric film, the first layer (8) is provided to form the second layer (9) having high crystallinity as mentioned above, and it is to be noted that the second layer (9) is dominantly responsible for the function exhibiting piezoelectricity. Therefore, the thinner the first layer (8), the better, to an extent that the first layer (8) can have a function serving to form an excellent second layer and that the piezoelectric characteristics of the piezoelectric film (5) as a whole do not decrease. We have confirmed that the first layer (8) can sufficiently exhibit its function even if it is 5 nm or less in thickness when a sputtering apparatus which is excellent in film thickness controllability is used. However, it is preferable for the thickness of the first layer to be controlled within a range of 50 to 100 nm in consideration of uniform coating of the Pt electrode and control of the production steps. Within this range, a substantial degradation in the piezoelectric characteristics of the piezoelectric film (5) as a whole can be prevented, and the first layer can sufficiently contribute to formation of a high quality second layer, and also, additional burdens for controlling the steps of forming the piezoelectric film (5) can be decreased. We also have confirmed that, in the first embodiment, by forming the first layer (8) as a $PbTiO_3$ layer with a thickness of 0.1 μm and the second layer (9) as a PZT layer with a thickness of 2.9 μm having a composition formula of $Pb(Zr_{0.53}Ti_{0.47})O_3$, there can be provided an ink-jet head capable of exhibiting a sufficient ink-jetting ability even at a low voltage.

Again, in the present invention, the thickness of the second layer (9) composed of PZT is not particularly limited. However, it is preferable that the thickness of the second layer (9) is controlled to 10 μm or less, because, when the second layer is formed by the thin film forming process, it takes long time in forming the film if the thickness of the second layer becomes large. In the meantime, after formed, the piezoelectric film (5) is subjected to patterning so as to have a given shape and size corresponding to each of the compression chambers. In this regard, it is more preferable that the thickness of the piezoelectric film (5) is controlled to 5 μm or less so as to achieve accurate patterning which can correspond to the intervals between each of the ink outlets (2) which are considered to be more necessary to be still narrower in future. On the other hand, it is preferable that the thickness of the piezoelectric film (5) is controlled to 0.5 μm or more in consideration of the strength of the film and a stress which would occur. According to our examination, it is the most preferable that the thickness of the piezoelectric film (5) is controlled within a range of 1 to 3 μm. It is confirmed within this range that ink droplets can stably jet and that the reliability of the film can be maintained constant or higher.

In the first embodiment, the body (50) is formed from stainless steel (SUS), but it may be formed from a photosensitive organic polymeric material, photosensitive glass, silicone or the like other than stainless steel.

Also, fine processing of the vibration plate (4) becomes easy by using the thin film forming process such as the sputtering process. In the first embodiment, the vibration plate (4) is formed from silicon dioxide ($SiO_2$), but it may be formed from a metal such as nickel, chrome, aluminum or the like other than silicon oxide. The vibration plate can be easily formed from any of these metals by the sputtering process, vacuum deposition process, or metallizing plating process, having vibration characteristics as excellent as those of the $SiO_2$ vibration plate. Further, a vibration plate (4) formed from alumina can exhibit a similar effect to that of the $SiO_2$ vibration plate, and it also can be easily formed by the sputtering process. Besides, a polyimide resin can be used to form a vibration plate (4), and the vibration plate (4) can be easily formed from a polyimide resin by the spin-coating process, and its fine processing is also easy. Thus, polyimide resins are found to be suitable materials for vibration plates of ink-jet recorders.

Any of the vibration plates (4) formed from the above-listed materials shows no degradation such as cracks which occur during the vibrating operation, and they can sufficiently vibrate to jet ink droplets. Further, vibration plates (4) formed from oxides of the above-listed metals can exhibit the same vibration characteristics as those of the vibration plate formed from the above metals. Further, the use of a vibration plate (4) formed from photosensitive polyimide is effective to facilitate the formation of piezoelectric elements.

Further, in the above-described structure, as the vibration plate (4) which faces the compression chamber (1), a $SiO_2$ layer having a thickness of 2 $\mu$m is used; as the second layer (9) of the piezoelectric film (5), a PZT thin film of the composition formula of $Pb(Zr_{0.5}Ti_{0.5})O_3$, having a thickness of 3 $\mu$m is used; and as the electrodes (6) and (7), platinum layers having a thickness of 0.1 $\mu$m are used. Under the above conditions, the vibration plate (4) can be caused to sufficiently generate flexural vibration even by application of 50 V or less. However, it is to be noted that the thickness of the vibration plate (4) is not limited to 2 $\mu$m as specified above, and the thickness of the vibration plate (4) should be selected appropriately, taking into account the piezoelectric characteristics and thickness of the piezoelectric film (5), the inherent vibration characteristics of materials forming the vibration plate (4) and the like.

Further, in the present invention, by using platinum, gold or a ruthenium oxide as a material for the electrode (11) to be formed on the MgO substrate (10), the piezoelectric films (5, 12) composed of lead-based dielectric layers having perovskite structures can be provided having good crystallinity. The piezoelectric films (5, 12) which have a little variation in the characteristics can be formed on an electrode formed from any of the above-listed materials, so that variation in ink-jetting ability between each of the elements can be decreased.

Further, although fine processing of the PZT thin film is carried out using a strong acidic solution such as hydrofluoric acid and nitric acid, corrosion of the electrode materials can be prevented by using platinum, gold or a ruthenium oxide as a material for the electrode, so that the elements can be reliably formed.

Further, it is preferable that PZT, for use as a piezoelectric material for the second layer which constitutes the piezoelectric films (5, 12), is formed into a PZT layer in which the ratio of Zr/Ti is from 30/70 to 70/30 to impart the PZT layer excellent piezoelectric characteristics. Also, in the present invention, other than PZT, for example, piezoelectric materials which contain other elements than Pb, Ti and Zr, and have the composition formula of $Pb_{0.99}Nb_{0.02}[(Zr_{0.6}Sn_{0.4})_{1-y}Ti_y]_{0.98}O_3$ ($0.060 \leqq y \leqq 0.065$) may be used as piezoelectric materials for the second layer. In this connection, there is no problem in the use of the piezoelectric material having the composition formula of $Pb_{0.99}Nb_{0.02}[(Zr_{0.6}Sn_{0.4})_{1-y}Ti_y]_{0.98}O_3$ ($0.060 \leqq y \leqq 0.065$), although it is an antiferroelectrics.

Figure 8:
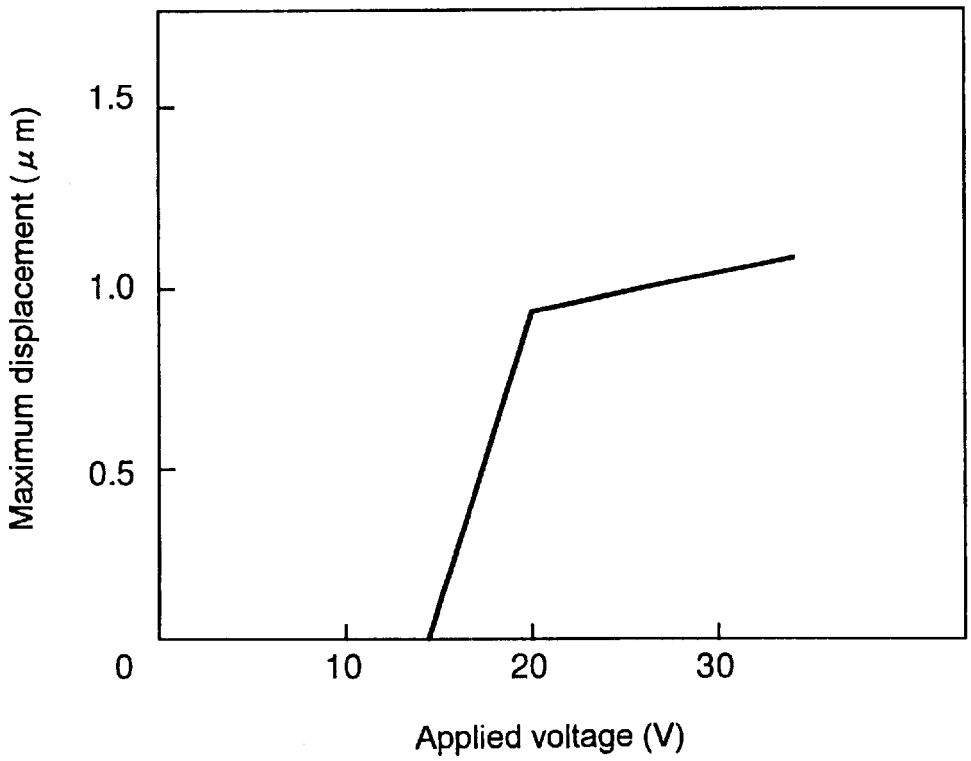
FIG. 8 is a graph showing a bending amount of the vibration plate relative to an applied voltage in another example of the ink-jet heads of the first embodiment.

The graph in FIG. 8 shows a relationship between a voltage applied and the maximal displacement of the vibration plate (4) in this case. When a voltage of 15 V is applied, a phase change from the antiferroelectrics to ferroelectrics occurs, so that discontinuous displacement characteristics are shown. When a voltage of 20 V is applied, the vibration plate (4) shows displacement of about 0.8 $\mu$m. When a certain value of voltage more than 20 V is applied, approximately constant displacement can be caused, so that the variation in the ink-jetting amount can be decreased. In addition, there can be provided a piezoelectric element which has a stable ink-jetting ability in spite of being a polycrystalline thin film when the antiferroelectric thin film of the composition formula of $Pb_{0.99}Nb_{0.02}[(Zr_{0.6}Sn_{0.4})_{1-y}Ti_y]_{0.98}O_3$ ($0.060 \leqq y \leqq 0.065$) is used.

Further, in the first embodiment, as the most preferable example of the piezoelectric films, there is given such one that comprises the first layer (8) composed of a layer of $PbTiO_3$ containing no Zr, or of a layer of PLT which contains $PbTiO_3$ and additional lanthenum (La), and the second layer (9) composed of a layer of $Pb(Zr_{0.53}Ti_{0.47})O_3$. However, the present invention is not limited to this piezoelectric film. Otherwise, a second layer having good crystallinity and a comparatively large piezoelectric constant can be formed when a PZT layer of the composition formula of $Pb(Zr_xTi_{1-x})O_3$ ($x<0.3$) or the PZT layer further containing La is used as the piezoelectric material for the first layer (the initial layer) which constitutes the piezoelectric films (5, 12), and a PZT layer of the composition formula of $Pb(Zr_xTi_{1-x})O_3$ ($0.7 \geqq x \geqq 0.3$) is used as the second layer. In this case, it is preferable that a PZT layer of the composition formula of $Pb(Zr_xTi_{1-x})O_3$ ($X<0.2$) or the PZT layer further containing La is used as the first layer.

The Second Embodiment

Figure 9:
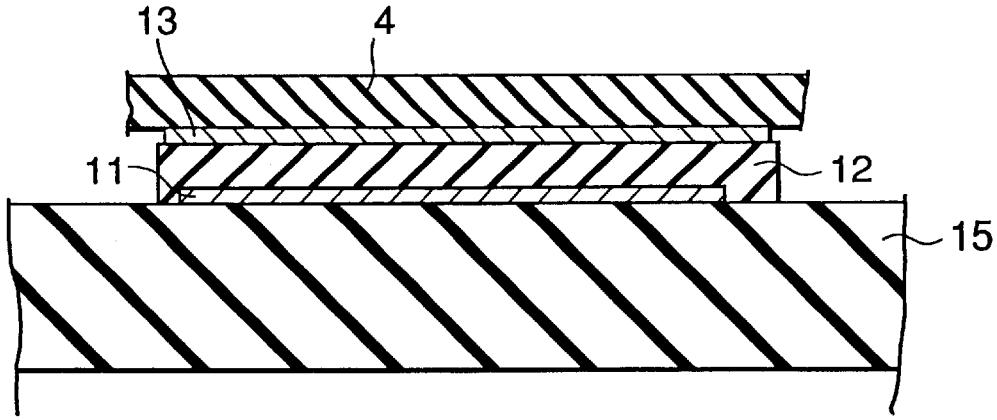
FIG. 9 is a sectional view of a piezoelectric vibration section formed on a silicone substrate (15), illustrating the step of forming the same in process of producing an ink-jet head of the second embodiment of the present invention.
Figure 10:
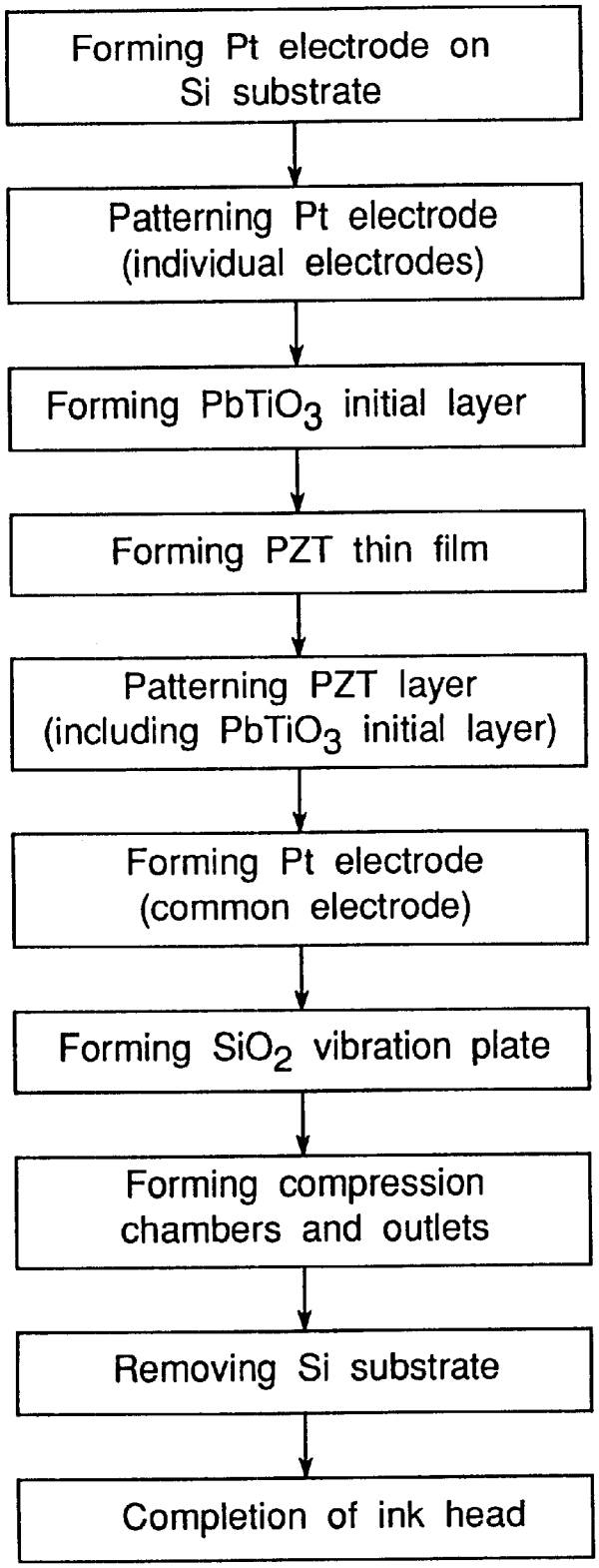
FIG. 10 is a flowchart for describing the main steps of producing an ink-jet head of the second embodiment.

FIGS. 9 and 10 illustrate the method of producing an ink-jet head according to the second embodiment of the present invention. The production method for the second embodiment is almost the same as that for the first embodiment except that a silicone (Si) substrate is used instead of the-MgO substrate used in the first embodiment.

First, as shown in FIGS. 9 and 10, a Pt layer for forming individual electrodes (11) is formed on a silicone substrate (15), and a piezoelectric film (12) composed of lead-based dielectric layer is formed as a piezoelectric material on the individual electrodes (11) by the sputtering process. The piezoelectric film (12) composed of the lead-based dielectric layer is provided by forming a first layer from a lead-based dielectric material containing no Zr, and then, forming a second layer from PZT containing Zr as in the first embodiment. Although the piezoelectric film (12) thus formed is of polycrystalline, the second layer which has very excellent piezoelectric characteristics can be formed because the first layer is formed from the lead-based dielectric material containing no Zr, and then, the second layer is formed from PZT containing Zr. The piezoelectric film (12) can have excellent piezoelectricity by forming a PZT-based polycrystalline layer with a thickness of 3 $\mu$m. In forming the piezoelectric film (12), a piezoelectric thin film having high crystallinity can be formed by the spin-coating process using MOCVD or a sol-gel solution instead of the above-mentioned sputtering process. Next, a Pt layer for a common electrode (13) is formed on the piezoelectric film (12). Where the spin-coating process using a sol-gel solution is adopted, first, a sol-gel solution containing no Zr is applied to form-the first layer, and then, a sol-gel solution containing Zr is applied to the first layer so as to form the second layer with a given thickness, and the layers are baked to form a piezoelectric film (12). Thus, the piezoelectric film (12) which is a polycrystalline layer can be formed as well as that formed by the sputtering process.

A vibration plate (4) is formed from a material of $SiO_2$ on the common electrode (13) by the sputtering process. Next, a body having compression chambers (1) formed therein from a photosensitive resin is assembled on the vibration plate (4), and finally, the silicone substrate (15) is removed by etching using a hydrofluoric acid solution or a potassium hydroxide solution. The compression chambers (1) divided in the body so as to correspond to the outlets, respectively, are formed from a photosensitive glass or a photosensitive resin. In the flowchart of FIG. 10, the individual electrodes (11) are formed by patterning before the formation of the piezoelectric film (12), but the individual electrodes (11) may be formed by patterning after the etching of the silicone substrate (15). Also, the piezoelectric film (12) is subjected to patterning before the formation of the common electrode (13) in the flowchart of FIG. 10, but the piezoelectric film (12) may be patterned so as to be divided into shaped pieces which correspond to the divided compression chambers (1) after the etching of the silicone substrate (15). According to the production method described in the present embodiment, it becomes possible to use a silicone substrate (15) which is a more available single crystal substrate capable of having a larger area at a lower cost than the MgO substrate (10). Therefore, it becomes possible to form a plurality of piezoelectric elements for jetting ink droplets at once and further to form thin film materials having excellent piezoelectric characteristics. Further, the fine processing techniques which have been established in the filed of silicones can be applied to the piezoelectric elements, and this facilitates multi-element formation which would be achieved by very high accurate fine processing. The ink-jet head produced by the above method can have the same structure as shown in FIG. 6, having nozzles at a density of 200 dpi. Furthermore, it is possible to produce an ink-jet head having nozzles at a higher density.

In the production of the ink-jet heads having the above structure, other than the silicone substrate (15), a glass substrate may be used, and it is possible to produce an ink-jet head which has a similar multi-element formation structure by using a glass substrate. In this case, the glass substrate is removed by etching using a hydrofluoric acid solution. Thus, an ink-jet head having the same multi-element formation structure as that shown in FIG. 6 can be provided.

A piezoelectric film (12) having a perovskite structure and a high crystallinity can be formed by using a ruthenium oxide for the above individual electrodes (11) other than platinum. The piezoelectric film, therefore, can have excellent characteristics, so that an ink-jet head having a little variation in the ink-jetting ability between each of the elements can be provided in spite of having the multi-element formation structure. Further, as the piezoelectric film (12) for the use as a piezoelectric material, a PZT layer having a ratio of Zr/Ti within a range of 30/70 to 70/30 shows further excellent piezoelectric characteristics, thus providing an ink-jet head having a high ink-jetting ability. Again, when a thin film of an antiferroelectrics of the composition formula of $Pb_{0.99}Nb_{0.02}[Zr_{0.6}Sn_{0.4}]_{1-y}Ti_y]_{0.98}O_3$ ($0.060 \leqq y \leqq 0.065$) is used as the piezoelectric film (12), a stable response can be obtained relative to application of a voltage, so that variation in the ink-jetting amount between each of the elements can be decreased.

As the materials for the vibration plate (4), besides silicon dioxide ($SiO_2$), metals such as nickel and aluminium can be easily formed into films by the sputtering process, vacuum deposition process or metallizing plating process, and the resultant films can show excellent vibration characteristics as well as the $SiO_2$ vibration plate. Furthermore, a vibration plate formed from an oxide such as alumina or the like can provide the same effect as that obtained by the $SiO_2$ vibration plate, and the oxide such as alumina or the like can be easily formed into a film by the sputtering process. Otherwise, high molecular organic substances such as polyimide resins can be easily formed into films by the spin coating process, and the processing thereof is also easy. Thus, high molecular organic substances such as polyimide resins are found to be suitable materials for the vibration plates of ink-jet heads.

The Third Embodiment

Figure 11:
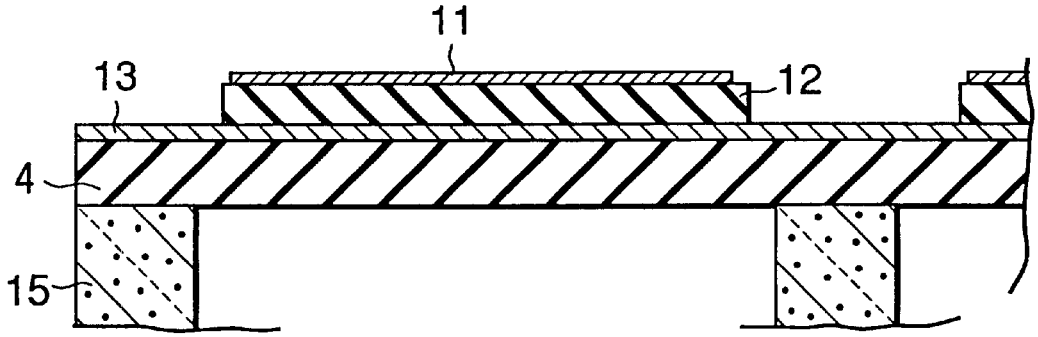
FIG. 11 is a partial sectional view of an ink-jet head produced by a method of producing the third embodiment, showing the features of the same.
Figure 12:
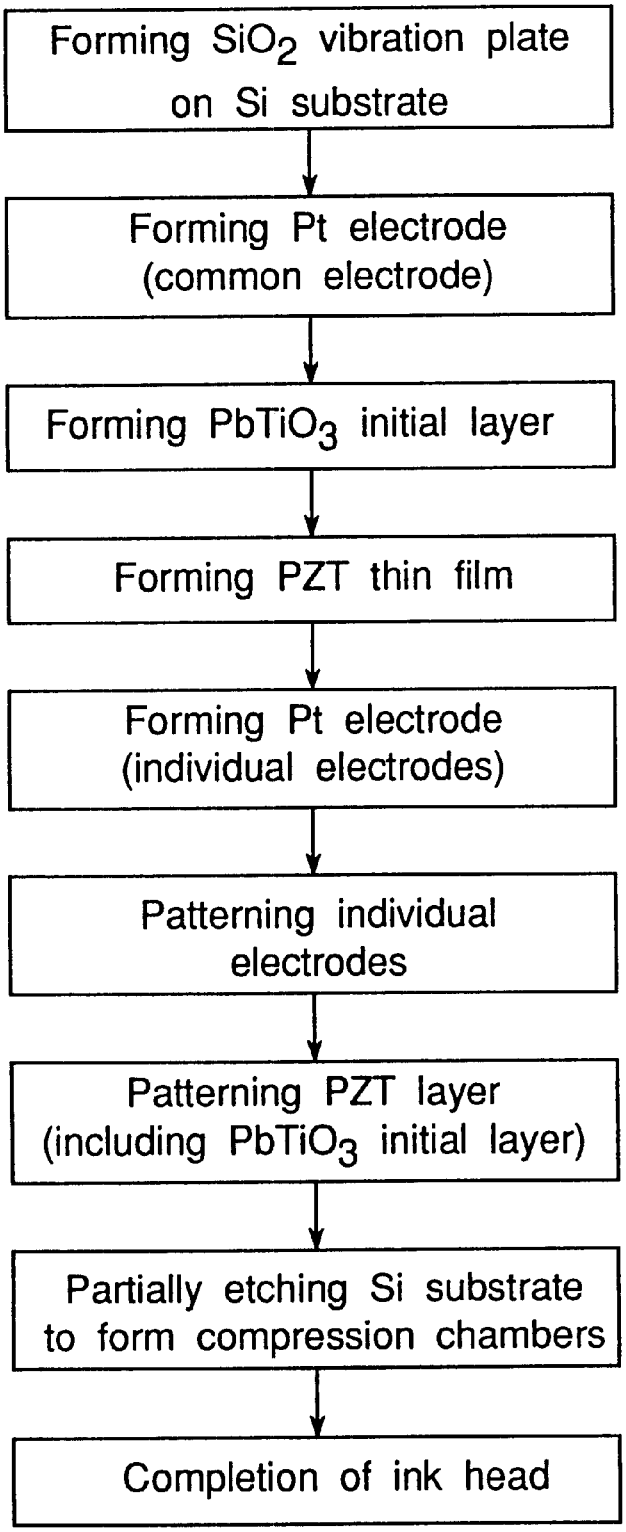
FIG. 12 is a flowchart for describing the main steps of the method of producing the ink-jet head of the third embodiment.

With reference to FIGS. 11 and 12, an ink-jet head according to the third embodiment of the present invention will be described.

In the present method, as shown in FIG. 11 and the flowchart of FIG. 12, firstly, a vibration plate (4) is formed from silicon dioxide ($SiO_2$) with a thickness of 2 $\mu$m on a silicone substrate (15) by the sputtering process, or by thermally oxidizing the silicone substrate. Then, a Pt layer for a common electrode (13) is further formed on the vibration plate (4). Then, a piezoelectric film (12) formed from a lead-based dielectric material is formed on the common electrode (13) by the rf sputtering process. As in the first embodiment, the piezoelectric film (12) is formed by forming a first layer from a lead-based dielectric material containing no Zr and forming a second layer from PZT containing Zr. The piezoelectric film (12) thus formed is of polycrystalline, but can comprise the second layer having very excellent piezoelectric characteristics, because the second layer composed of the PZT layer containing Zr is formed after the formation of the first layer composed of the lead-based dielectric material containing no Zr. The piezoelectric film (12) can obtain excellent piezoelectric characteristics by forming a PZT type polycrystalline layer with a thickness of 3 $\mu$m. As one of the methods of forming piezoelectric films (12), a piezoelectric thin film having a high crystallinity can be formed also by the spin-coating process using MOCVD or a sol-gel solution. Next, a Pt layer for individual electrodes (11) is formed on the piezoelectric film (12). The individual electrodes (11) are formed by subjecting the Pt layer to fine processing through ion etching so as to be formed into divided shaped pieces which correspond to the respective compression chambers (1). In the meantime, when the vibration plate (4) is formed from an insulating substance, the individual electrodes (11) may be formed on the vibration plate (4), and the common electrode (13) may be formed on the piezoelectric film (12).

Next, the silicone substrate (15) is partially removed by etching using a hydrofluoric acid solution or a potassium hydroxide solution, and the remaining parts of the silicone substrate (15) are used as the structural parts of the compression chambers (1). The piezoelectric film (12) is subjected to patterning so as to be divided into shaped pieces which correspond to the respective compression chambers (1) before the formation of the common electrode (13). In this method, the compression chambers (1) are formed by using parts of the substrate for forming the piezoelectric element, so that the production step can be simplified. Furthermore, it becomes possible to provide finely formed elements by applying the fine processing techniques for silicones. The ink-jet head produced by the above method can have the same structure as that shown in FIG. 6, having nozzles at a density of 200 dpi or more.

In the production of the ink-jet head having this structure, a more inexpensive glass substrate can be used other than the silicone substrate (15), and also, by using the glass substrate, an ink-jet head having the same multi-element formation structure as that shown in FIG. 6 can be provided.

When a ruthenium oxide other than platinum is used to form individual electrodes (11), a piezoelectric film (12) having a perovskite structure with a high crystallinity can be formed. The piezoelectric film can have excellent properties, so that there can be provided an ink-jet head having a little variation in ink-jetting ability between each of the piezoelectric elements in spite of having the multi-element formation structure. Further, when the piezoelectric film (12) to be used as a piezoelectric material is a PZT layer having a Zr/Ti ratio within the range of 30/70 to 70/30, the piezoelectric material can have further excellent piezoelectric characteristics, and the resultant ink-jet head can have high ink-jetting ability.

Further, when an antiferroelectric thin film of the composition formula of $Pb_{0.99}Nb_{0.02}[(Zr_{0.6}Sn_{0.4})_{1-y}Ti_y]_{0.98}O_3$ ($0.060 \leqq y \leqq 0.65$) is used as the piezoelectric film (12), a piezoelectric element formed of the above film can stably respond to a voltage applied, and is decreased in variation in ink-jetting amount. Further, when an antiferroelectric thin film of the composition formula of $Pb_{0.99}Nb_{0.02}[(Zr_{0.6}Sn_{0.4})_{1-y}Ti_y]_{0.98}O_3$ ($0.060 \leqq y \leqq 0.065$) is used as the piezoelectric film, there can be provided a piezoelectric element which has a stable ink-jetting ability even when formed of a polycrystalline thin film.

Furthermore, the vibration plate (4) can be easily formed from a metal such as nickel and aluminium other than silicon dioxide $SiO_2$ by the sputtering process, vacuum deposition process or metallizing plating process, and the resultant vibration plate (4) can have excellent vibration characteristics as well as the $SiO_2$ vibration plate. Also, alumina can be used to form a vibration plate, and the alumina vibration plate can be easily formed by the sputtering process, and provide the same effect as the $SiO_2$ vibration plate. Besides, the vibration plate can be easily formed from a polyimide resin by the spin-coating process, and the processing of the polyimide resin vibration plate is also easy. Thus, polyimide resins are found to be suitable materials for ink-jet heads.

The Fourth Embodiment

Figure 13A:
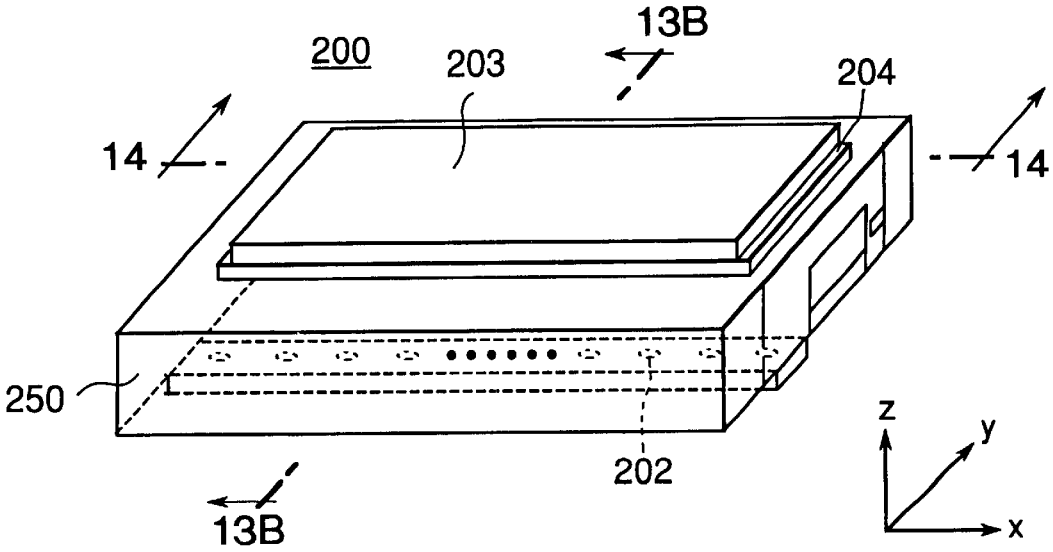
FIG. 13A is a perspective view of an ink-jet head of the fourth embodiment of the present invention.
Figure 13B:
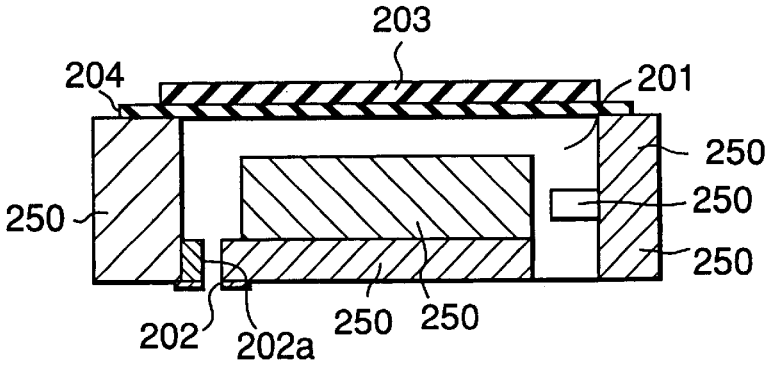
FIG. 13B is a sectional view of the ink-jet head taken along line 13B—13B of FIG. 13A.

FIG. 13A is a perspective view of an ink-jet head (200) according to the fourth embodiment of the present invention; FIG. 13B is a sectional view of the same taken along line 13B-13B of FIG. 13A; and FIG. 14 is a sectional view of the same taken along line 14—14 of FIG. 13A.

The ink-jet head (200) comprises a body (250) having a plurality of outlets (202) and a plurality of compression chambers (201) formed corresponding to the plurality of outlets (202), respectively; a vibration plate (204) provided on top of the body (250); and a piezoelectric element (203) provided on the vibration plate (204).

In the body (250), the outlets (202) are formed at predetermined intervals in the lower plane of the body (250), and the compression chambers (201) are formed in parallel with the body (250) and corresponding to the outlets (202), respectively. Each of the outlets (202) communicates with each of the compression chambers (201) through an ink passage (202*a*) formed in the body (250). The body (250) is formed from a highly rigid material such as a resin, glass, stainless steel, ceramics, silicone or the like.

Figure 14:
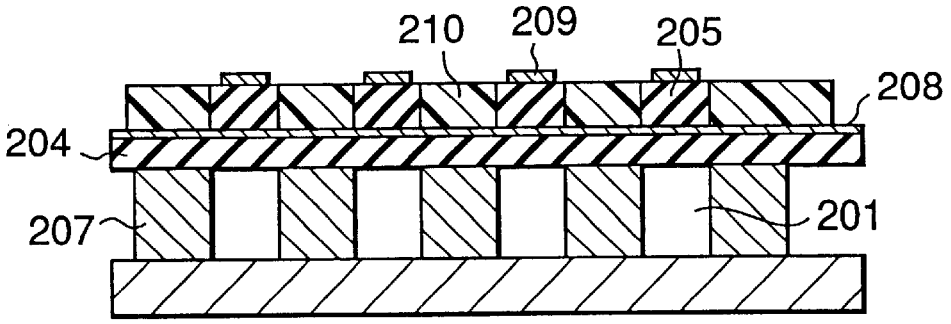
FIG. 14 is a sectional view of the ink-jet head taken along line 14—14 of FIG. 13A.

The piezoelectric element (203) comprises, as shown in FIG. 14, a common electrode (208) formed on the vibration plate (204); piezoelectric films (205) formed on the common electrode (208) at predetermined intervals corresponding to the compression chambers (201), respectively; and individual electrodes (209) provided on the piezoelectric films (205), respectively, and further, a filler of a polyimide resin is packed in the spaces between each of the piezoelectric films (5) adjacent to each other. In this connection, the piezoelectric film (205) is formed having a first layer (8) composed of a layer of $PbTiO_3$ containing no Zr, or PLT containing $PbTiO_3$ and lanthanum, and a second layer (9) composed of a layer of the composition formula of $Pb(Zr_{0.53}Ti_{0.47})O_3$ with a thickness of about 3 $\mu$m, as in the first embodiment. Thus, the piezoelectric film (205) having excellent piezoelectric characteristics is formed as well as that of the first embodiment.

The vibration plate (204) is comprised of an alumina layer which is formed with a thickness of 2 $\mu$m by the sputtering process, and both the common electrode (208) and the individual electrodes (209) are comprised of Pt layers with a thickness of 0.1 $\mu$m, respectively. As the materials for the vibration plate (204), Ni, Cr, Ti, Al and Zr can be used other than alumina, and any of the materials can provide a vibration plate which is excellent in adhesion to the piezoelectric film (205) and the electrode material and in vibration characteristics. In the present invention, oxides of Ni, Cr, Ti, Al and Zr, silicon oxide, and resins can be used as the materials for the vibration plate (204). Further, it is preferable that the thickness of the vibration plate (204) is equal to or smaller than that of the piezoelectric film (205) so as to obtain excellent ink-jetting ability.

It is preferable that the piezoelectric film (205) is formed with a narrower width than that of the compression chamber to which the piezoelectric film (205) correspond.

However, the present invention is not limited to the above piezoelectric film (205). A single undivided and continuous piezoelectric film may be used instead of the divided piezoelectric films, and the individual electrodes (209) may be formed so as to correspond to the compression chambers (201), respectively. Thus constructed, ink droplets are jetted by vibrating only parts of the piezoelectric layer that correspond to some of the compression chambers.

The material for the filler (210) to be packed between each of the piezoelectric films (205) adjacent to each other is not limited to the polyimide resin as mentioned above, and any material that has a comparatively low rigidity can be used. The use of a comparatively low rigid material as the filler makes it possible to vibrate the piezoelectric film (205) without preventing lateral expansion or contraction of the piezoelectric film (205). Therefore, the vibration characteristics do not degrade.

For example, when each of the compression chambers (201) is formed with a width of 70 $\mu$m and the piezoelectric film (205) with a width slightly narrower than that of the compression chamber (201), the vibration amplitude can be changed by maximum 50 nm when a voltage of 10 V is applied.

As described above, according to the fourth embodiment, the piezoelectric film (205) is formed having the first layer and the second layer as a two-layer structure by the thin film forming process such as the sputtering process as in the first embodiment. Therefore, the piezoelectric film (205) can have a very high density, high crystallinity, and excellent vibration characteristics despite of the comparatively simple structure. This is because the formation of the piezoelectric film (205) having a high crystallinity makes it possible for the piezoelectric element to be driven by application of such a high voltage that would cause a conventional sintered body to be dielectrically broken down. Furthermore, since the piezoelectric film (205) can be formed with a very small thickness as in the first embodiment, fine processing can be easily conducted on such a film, so that an ink-jet head having nozzles at a density of 200 dpi can be easily produced.

The piezoelectric film (205) may be formed by the thin film forming process such as CVD process other than the spin coating process as mentioned above.

The thickness of the piezoelectric film (205) is preferably 10 μm or less because, when it is 10 μm or more, fine processing is hardly done on it.

In the fourth embodiment, the piezoelectric film (205) is formed by using an MgO substrate or a Si substrate as in the first or second embodiment.

In detail, as the substrate, a single crystal MgO substrate which is cleavaged to have a plane (100) as the surface is used, and an initial layer containing no Zr is formed on the plane (100) of the MgO substrate. Then, a piezoelectric film of the general formula of $(Pb_{1-x}La_x)(Zr_{1-y}Ti_y)O_3$ is formed on the initial layer so as to form a piezoelectric film in which the crystals orient in a direction of the axis c. As described above, the addition of La to the piezoelectric film represented by the general formula of $Pb(Zr_{1-y}Ti_y)O_3$ decreases the crystallization temperature, so that the piezoelectricity of the piezoelectric thin film can be improved. Further, the single crystal piezoelectric film of the formula of $(Pb_{1-x}La_x)(Zr_{1-y}Ti_y)O_3$ thus formed can have a piezoelectric constant 1.5 times as large as that of a polycrystalline film of the same composition.

Further, in forming the piezoelectric film (205), by using the sputtering process or the CVD process, a single crystal film having high crystallinity can be formed at a high deposition rate of 1 μm or more per hour. Furthermore, by using platinum or ruthenium oxide as the material for the electrode, the piezoelectric film can grow while maintaining good interface properties. When platinum or ruthenium oxide is used for the electrode, it becomes possible to use, other than magnesium oxide (MgO), silicone, glass, or stainless steel material which has a high rigidity and can be finely processed with ease, as the material for the substrate. As a result, the production cost for ink-jet heads can be reduced.

Further, when the piezoelectric film of the general formula of $(Pb_{1-x}La_x)(Zr_{1-y}Ti_y)O_3$ is formed on the electrode of platinum or ruthenium oxide, the piezoelectric film (205) having high crystallinity can be formed because deposition of an impurity layer of Zr on the electrode can be prevented by particularly adjusting the value of y to 0.7 or more (by decreasing the amount of Zr) in the composition formula of a part of the piezoelectric film in contact with the electrode. Therefore, by forming an initial layer containing a decreased amount of Zr directly on the electrode, and forming, on the initial layer, a piezoelectric film which has a large piezoelectric constant and a thickness of several μm and is represented by the composition formula having 'y' adjusted to 0.7 or less, the piezoelectric film (205) having a large piezoelectric constant can be formed with high crystallinity.

Furthermore, because the ink-jet head of the present invention comprises a thin piezoelectric film and a vibration plate as mentioned above, it is necessary to take care in bonding the body having the compression chambers formed therein to the vibration plate. That is, when the partition walls of the body are bonded to the vibration plate with adhesive, a large stress is applied to the thin piezoelectric film (205) because of the expansion or contraction of the adhesive in process of the curing thereof, so that the film cracks or peels. Even though the film could not be so damaged as to crack or peel, stable vibration would be hindered.

Figure 16:
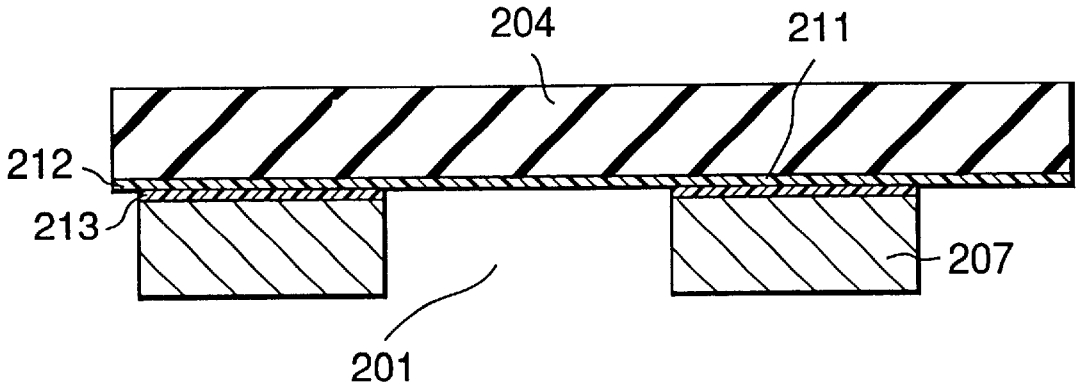
FIG. 16 is a partial sectional view of a preferable bonding structure of the fourth embodiment.

In order to solve the above problem, it is preferable in the fourth embodiment that the partition walls (207) of the body are bonded to the vibration plate (204) through a resin layer (212) which has a thickness of 2 μm or so and a low rigidity as shown in FIG. 16. The resin layer (212) is formed from, for example, polyimide by the spin coating process or the like. In this connection, number 213 which appears in FIG. 16 refers to the adhesive.

As described above, by providing the polyimide resin layer (212), a stress due to expansion or contraction of the adhesive (213) can be prevented from applying to the piezoelectric film (205), so that the piezoelectric film can be stably vibrated, and simultaneously damage of the piezoelectric film can be prevented. Further, by providing the polyimide resin layer, an ink can be avoided from directly contacting the vibration plate, so that the life of the vibration plate can last longer. In this regard, it is preferable that the thickness of the resin layer (212) is 3 μm less. When it is 3 μm or more, the resin layer absorbs the vibrations of the vibration plate, so that the ink-jetting performance significantly degrades.

Figure 17:
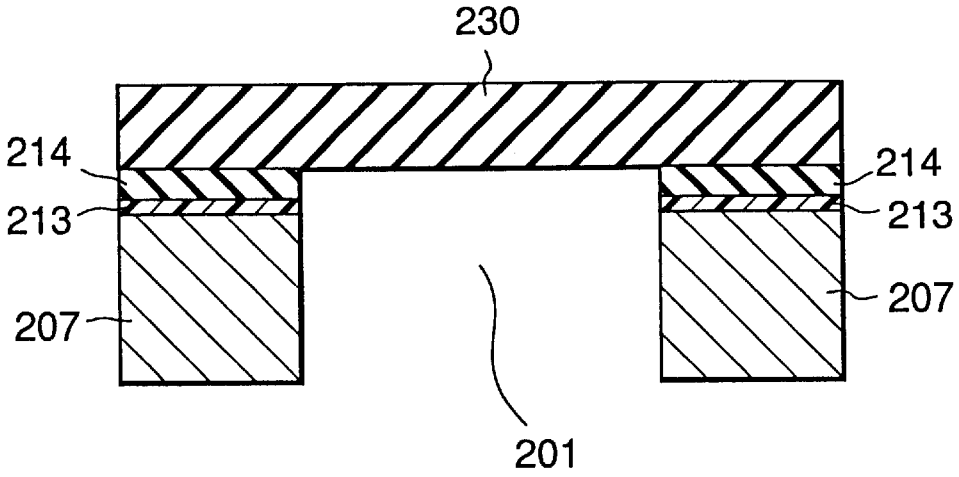
FIG. 17 is a partial sectional view of another preferable bonding structure of the fourth embodiment.

Furthermore, it is necessary to accurately control the amounts and thickness of the resin layer (212) and the adhesive (213) in order to more effectively exhibit the ink-jetting performance and to decrease variations in the ink-jetting amount and the ink-jetting speed. In FIG. 17, an alumina layer (214) with a thickness of 7 μm is seen to be formed on parts of the piezoelectric vibration section (230) (comprising the piezoelectric element and the vibration plate) to which the partition walls are bonded. The alumina layer (214) is formed as follows: an alumina layer is formed with a thickness of 7 μm on the piezoelectric vibration section (230) and, then, the alumina layer is subjected to wet etching using an acidic solution so that the parts of the alumina layer which correspond to the partition walls can be left to remain. By bonding the partition walls (207) to the piezoelectric vibration section (230) through the alumina layer (214), only parts of the piezoelectric vibration section (230) which correspond to the compression chambers (201) can be vibrated, so that the variation in the ink-jetting amount or the like can be decreased. In the present invention, a layer which is formed from ceramics composed of various metal oxides, a highly rigid resin such as an epoxy resin, Cr or the like may be used instead of the alumina layer (214). That is, any material that shows good adhesion to the piezoelectric vibration section (230) and permits fine processing can be used.

Figure 15:
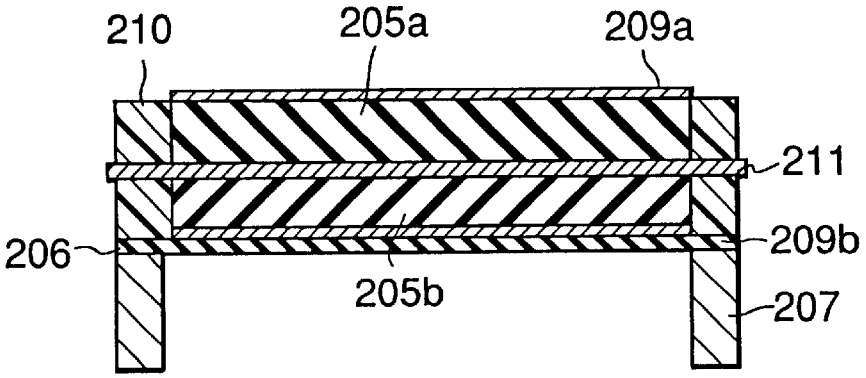
FIG. 15 is a partial sectional view of a piezoelectric vibration section of a modification of the fourth embodiment, showing the structure of the same.

In the above piezoelectric vibration section, the piezoelectric film (205) is composed of one layer, but the piezoelectric film of the present invention is not limited to the above one-layer structure, and it may have two layers, i.e. the piezoelectric films 205*a* and 205*b*. as shown in FIG. 15. In this case, the individual electrode (209) is formed as separate electrodes (209*a*) and (209*b*), wherein the electrode (209*a*) is formed on the piezoelectric film (205*a*) and the electrode (209*b*) is formed on the underside of the piezoelectric film (205*b*), and an intermediate electrode (211) as a common grounding electrode is formed between the piezoelectric films (205*a*) and (205*b*). As described above, by composing the piezoelectric film (205) of two layers of the piezoelectric films (205*a*) and (205*b*), the piezoelectric vibration section can show displacement two times larger than that shown by a piezoelectric vibration section comprising one piezoelectric film. In this connection, each of the piezoelectric films (205*a*) and (205*b*) comprises an initial layer (a first layer) and a second layer. With this arrangement, the piezoelectric vibration section generate flexural vibration by using the piezoelectric films (205*a*) and (205*b*), so that theoretically, it becomes unnecessary to provide the vibration plate (204) which is caused to vibrate in cooperation with the piezoelectric film. As a result, it is sufficient to form a resin layer, for example, with a thickness of 1 $\mu$m or so for protecting the piezoelectric film from an ink. In other words, owing to the structure shown in FIG. 15, the piezoelectric vibration section can be provided by forming two piezoelectric films (205*a*) and (205*b*) without the need to provide a vibration plate.

The Fifth Embodiment

Figure 18:
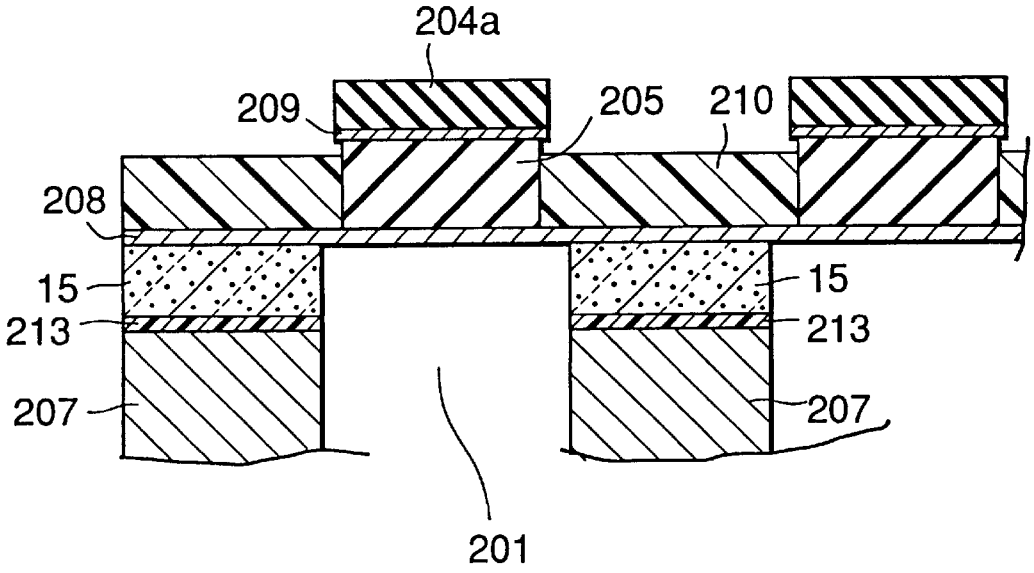
FIG. 18 is a partial sectional view of the structure of an ink-jet head of the fifth embodiment according to the present invention.

FIG. 18 is a partial sectional view of an ink-jet head according to the fifth embodiment of the present invention, illustrating the structure of the ink-jet head. The ink-jet head according to the fifth embodiment is produced by the following steps.

First, a Pt layer for a common electrode (208) is formed on a single crystal silicone substrate, and piezoelectric films (205) with a thickness of 3 $\mu$m and individual electrodes (209) each corresponding to each of compression chambers, are formed on the common electrode (208) in the same manner as in the first embodiment. Then, alumina layer with a thickness of 2 $\mu$m as vibration plates (204*a*) are formed on the individual electrodes (209). A filler polyimide resin (210) is packed in the space between each of the piezoelectric films (205) adjacent to each other. Next, the silicone substrate is polished to a thickness of about 0.1 mm, and the polished silicone substrate is subjected to etching using an alkaline solution such as an aqueous KOH solution, so that parts of the silicone substrate (silicone bases (15)) which correspond to the partition walls for separating the compression chambers, respectively, are left to remain. Then, the partition walls of a body, which has the compression chambers formed therein from a stainless steel, resin or glass, are faced to the silicone bases (15) and bonded thereto. Thus, the ink-jet head according to the fifth embodiment shown in FIG. 18 is completed. In the fifth embodiment, the width of the compression chamber (201) is 70 $\mu$m.

As described above, in the ink-jet head of the fifth embodiment, the silicone substrate is finely processed, and parts of the silicone substrate are used to form the compression chambers, and the adhesion parts of the body are kept distant from the piezoelectric films. Therefore, degradation of the vibration characteristics due to the affection of the adhesion parts can be substantially eliminated. As a result, in the ink-jet head of the fifth embodiment, the variation in the ink-jetting performance can be significantly decreased. Further, it is confirmed in the present embodiment that, when an initial layer of the composition formula of $(Pb_{0.95}La_{0.05})TiO_3$ is formed in process of forming the piezoelectric film (205), it is found that the initial layer with a high crystallinity can be formed on the Pt common electrode (208) at a temperature as low as 500° C. It is very useful in a practical view that the initial layer can be formed at such a low temperature.

Further, in the fifth embodiment, quartz glass may be used for the substrate instead of silicone. The use of quartz glass for the substrate makes it possible to finely process the substrate through etching using hydrofluoric acid, so that the ink-jet head can be produced at a still lower cost. Furthermore, by using an MgO substrate in which the MgO crystals orient on the plane (100), a piezoelectric film (205) of the composition formula of $Pb(Zr_{0.53}Ti_{0.47})O_3$, in which the crystals orient in the direction of axis c, can be formed through the initial layer on the Pt electrodes as described in the first embodiment. Thus, the resultant piezoelectric film can have a piezoelectric constant about 1.5 times larger than that of a piezoelectric film comprised of a polycrystalline thin film of the same composition formula. In the meantime, when an MgO substrate is used, the substrate is similarly polished or etched to a thickness of about 0.1 mm, and then processed as shown in FIG. 18, and the processed portions are bonded to the partition walls of the body.

The Sixth Embodiment

Figure 19:
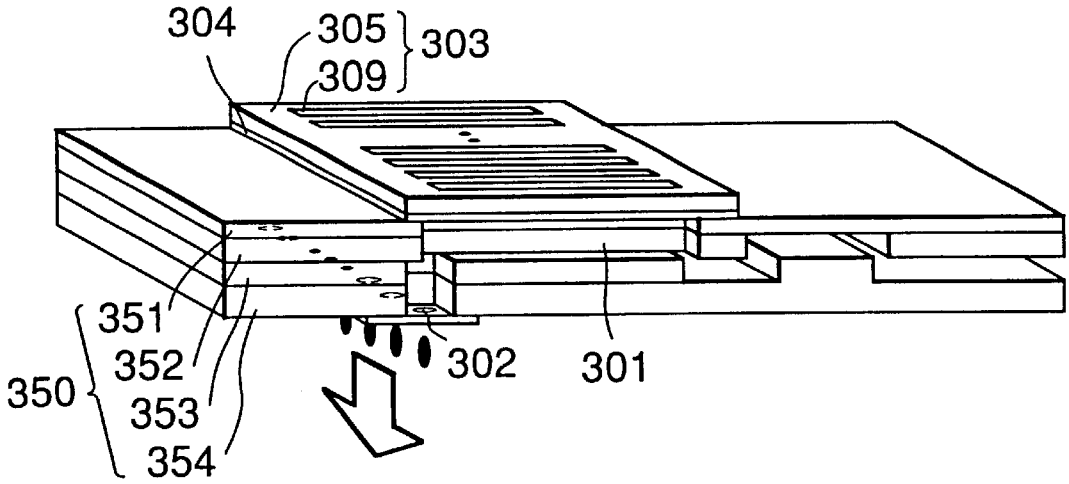
FIG. 19 is a perspective view of an ink-jet head of the sixth embodiment according to the present invention.

FIG. 19 is a perspective view of an ink-jet head according to the sixth embodiment of the present invention. The ink-jet head of the sixth embodiment comprises a body (350) composed of lamination of four stainless steel plates (351, 352, 353 and 354), and a piezoelectric vibration section (comprised of a piezoelectric element (303) and a vibration plate (304)) so provided as to close compression chambers (301) which are formed in the body (350). In addition, as shown in FIG. 19, ink outlets (302) are formed along the width direction in parallel with each other in the underside of the stainless plate (354). The ink chambers (301) which are divided by the partition walls (not shown) are provided corresponding to the ink outlets (302), respectively. The piezoelectric element (303) comprises a common electrode (not shown), a piezoelectric film (305) and individual electrodes (309). Each of the individual electrodes (309) is formed directly on each of the compression chambers (301), and thus, individual piezoelectric elements which correspond to the compression chambers (301), respectively, are provided. The piezoelectric film (305) is formed in the same manner as in the first to fifth embodiments.

In the sixth embodiment, the body (350) is composed of the stainless steel plates (351) to (354), but the present invention is not limited to this structure, and the body (350) may be composed of lamination of glass plates. Further, the body having the structure shown in FIG. 19 may be as be formed using resin plates.

INDUSTRIAL APPLICABILITY

As described above in detail, according to the present invention, it becomes possible to form piezoelectric films having smaller thickness and larger piezoelectric constants in comparison with the prior art, by using the thin film forming process such as the sputtering process and CVD process, so that it makes possible to finely process the piezoelectric films. Therefore, miniaturized ink heads for in-jet recorders which have ink outlets formed at higher densities and can respond at higher speeds can be provided. By using the miniaturized ink-jet heads having outlets formed at high densities therein, it becomes possible to provide ink-jet recorders which permit high-speed printing with high resolution.

What is claimed is:

1. An ink-jet head comprising a body having ink outlets and compression chambers respectively communicating with each of said ink outlets, and piezoelectric vibration sections, each being provided on a part of each of said compression chambers and including a piezoelectric film containing Pb, Ti and Zr, and electrodes provided on both sides of said piezoelectric film, wherein said piezoelectric vibration sections generate flexural vibration to jet ink droplets from said ink outlets, characterized in that said piezoelectric film comprises a first layer which has a perovskite structure containing Sr or Ba, and a second layer which has a perovskite structure containing Pb, Ti and Zr and is formed in contact with said first layer.

2. An ink-jet head comprising a body having ink outlets and compression chambers respectively communicating with each of said ink outlets, and piezoelectric vibration sections, each being provided on a part of each of said compression chambers and including a piezoelectric film containing Pb, Ti and Zr, and electrodes provided on both sides of said piezoelectric film, wherein said piezoelectric vibration sections generate flexural vibration to jet ink droplets from said ink outlets, characterized in that said piezoelectric film comprises a first layer and a second layer which have perovskite structures, respectively, and are formed in contact with each other, and that the content of Zr in said first layer is smaller than that in said second layer.

3. An ink-jet head comprising a body having ink outlets and compression chambers respectively communicating with each of said ink outlets, and piezoelectric vibration sections, each being provided on a part of each of said compression chambers and including a piezoelectric film containing Pb, Ti and Zr, and electrodes provided on both sides of said piezoelectric film, wherein said piezoelectric vibration sections generate flexural vibration to jet ink droplets from said ink outlets, characterized in that said piezoelectric film comprises a first layer containing no Zr and a second layer containing Zr, which have perovskite structures, respectively, and are formed in contact with each other.

4. An ink-jet head according to claim 2 or 3, wherein said first layer contains La.

5. An ink-jet head according to any one of claims 1 to 3, wherein the ratio of Zr/Ti contained in said second layer is controlled within a range of 30/70 to 70/30.

6. An ink-jet head according to any one of claims 1 to 3, wherein said piezoelectric film is single crystal film.

7. An ink-jet head according to any one of claims 1 to 3, wherein said piezoelectric film is formed with a thickness of 10 $\mu$m or less.

8. An ink-jet head according to claim 7, wherein said piezoelectric film is formed with a thickness of 1 $\mu$m to 3 $\mu$m.

9. An ink-jet head according to claim 7, wherein said first layer is formed with a thickness of 50 to 100 nm.

10. An in-jet head according to any one of claims 1 to 3, wherein said piezoelectric vibration section further comprises a vibration plate, and generates flexural vibration.

11. An ink-jet head according to claim 10, wherein said vibration plate is formed from at least one selected from the group consisting of Ni, Cr, Al and their oxides, Si, Si oxide, and high molecular organic substances.

12. An ink-jet head according to any one of claims 1 to 3, wherein said piezoelectric vibration section further comprises another piezoelectric film which is provided between each of the electrodes, said another piezoelectric film being different from the above piezoelectric-film and opposing the same film through an intermediate electrode layer, and wherein said piezoelectric vibration sections generate flexural vibration by said two piezoelectric films.

13. An ink-jet head according to any one of claims 1 to 3, wherein said second layer of said piezoelectric film contains Nb and Sn and has antiferroelectricity.

14. An ink-jet head according to any one of claims 1 to 3, wherein, in said first layer of said piezoelectric film, the density of Zr is so distributed as to continuously increase along the thickness direction, and said second layer is in contact with one surface of said first layer where the density of Zr is higher.

15. An ink-jet head according to any one of claims 1 to 3, wherein said electrode layers provided on both sides of said piezoelectric film are formed from Pt or Au.

16. An ink-jet head according to any one of claims 1 to 3, wherein said body has a plurality of ink outlets and a plurality of compression chambers formed corresponding to said ink outlets, respectively, and at least one of said electrodes provided on both sides of said piezoelectric film is so divided as to correspond to said compression chambers so that the piezoelectric vibration sections are provided corresponding to said compression chambers, respectively.

17. An ink-jet head according to claim 16, wherein said piezoelectric film is so divided as to correspond to said compression chambers, and one of said electrodes is formed over said divided piezoelectric films.

18. An ink-jet head according to claim 16, wherein a resin having such a low rigidity that does not hinder said piezoelectric films from expanding or contracting is packed in the spaces between each of said divided piezoelectric films.

19. An ink-jet head according to any one of claims 1 to 3, wherein the peripheries of said piezoelectric vibration sections are bonded to said peripheries of said compression chambers through resin layers having elasticity and a thickness of 3 $\mu$m or less.

20. An ink-jet head according to any one of claims 1 to 3, wherein said peripheries of said piezoelectric vibration sections are bonded to the peripheries of said compression chambers through mounts formed from a ceramics, metal or resin.

* * * * *

UNITED STATES PATENT AND TRADEMARK OFFICE

CERTIFICATE OF CORRECTION

PATENT NO. : 6,347,862 B1
DATED : February 19, 2002
INVENTOR(S) : Isaku Kanno et al.

It is certified that error appears in the above-identified patent and that said Letters Patent is hereby corrected as shown below:

Column 21,
Line 47, change “in-jet” to -- ink-jet --.

Column 22,
Line 7, change “piezoelectric-film” to -- piezoelectric film --.

Signed and Sealed this

Twenty-fourth Day of December, 2002

JAMES E. ROGAN
*Director of the United States Patent and Trademark Office*